US008955769B2

(12) United States Patent
Pelfrey et al.

(10) Patent No.: US 8,955,769 B2
(45) Date of Patent: Feb. 17, 2015

(54) VORTEX ATOMIZING FOAM PUMP AND REFILL UNIT UTILIZING SAME

(75) Inventors: Keith Allen Pelfrey, Wadsworth, OH (US); Richard C. Sayers, Marietta, GA (US); Nick E. Ciavarella, Seven Hills, OH (US); John J. McNulty, Broadview Heights, OH (US); Jackson W. Wegelin, Stow, OH (US)

(73) Assignee: GOJO Industries, Inc., Akron, OH (US)

( * ) Notice: Subject to any disclaimer, the term of this patent is extended or adjusted under 35 U.S.C. 154(b) by 514 days.

(21) Appl. No.: 13/309,755

(22) Filed: Dec. 2, 2011

(65) Prior Publication Data

US 2013/0140380 A1 Jun. 6, 2013

(51) Int. Cl.
*B05B 7/30* (2006.01)

(52) U.S. Cl.
USPC ..... 239/343; 239/333; 239/345; 239/369; 239/370; 239/379; 239/403; 239/409; 239/419.5; 239/428.5; 239/432; 222/145.6; 222/190; 222/321.8

(58) Field of Classification Search
USPC ..... 239/311, 340, 343, 344, 369, 370, 403, 239/407, 409, 419.5, 428.5, 432, 333, 345, 239/379; 222/145.5, 145.6, 190, 321.7, 222/321.8, 321.9
See application file for complete search history.

(56) References Cited

U.S. PATENT DOCUMENTS

| | | | | |
|---|---|---|---|---|
| 4,350,298 | A | | 9/1982 | Tada |
| 5,054,688 | A | | 10/1991 | Grindley |
| 5,397,060 | A | | 3/1995 | Maas et al. |
| 5,678,765 | A | | 10/1997 | Dobbs et al. |
| 5,848,752 | A | | 12/1998 | Kolacz et al. |
| 5,862,954 | A | * | 1/1999 | Ehrensperger et al. .... 239/428.5 |
| 6,308,866 | B1 | | 10/2001 | Hoang et al. |
| 6,527,202 | B1 | | 3/2003 | Tseng |
| 6,536,630 | B1 | | 3/2003 | Chan et al. |
| 6,604,656 | B1 | | 8/2003 | Tseng |
| 6,966,459 | B1 | | 11/2005 | Tseng |

(Continued)

FOREIGN PATENT DOCUMENTS

| | | |
|---|---|---|
| EP | 2087024 A2 | 8/2009 |
| EP | 2087825 A2 | 8/2009 |

(Continued)

OTHER PUBLICATIONS

PCT Search Report and Written Opinion Dated Mar. 18, 2013 in Related WIPO Application No. PCT/US2012/067551.

*Primary Examiner* — Steven J Ganey
(74) *Attorney, Agent, or Firm* — Calfee, Halter & Griswold LLP

(57) ABSTRACT

Foam dispensers, refill units for foam dispensers, and liquid pumps for use in foam dispensers are disclosed herein. In one embodiment, an inverted foam pump includes a compression chamber having an inlet valve and an outlet valve. The compression chamber is in fluid communication with a flow restrictor, an atomizer, a mixing chamber, a foaming chip and an outlet. The inlet valve, outlet valve, flow restrictor, atomizer, mixing chamber, foaming chip and outlet extend along a common axis. An air inlet is included that extends into the mixing chamber; the air inlet is an opening to atmospheric pressure. During operation, the liquid pump is located below the liquid container and liquid flowing from the compression chamber is accelerated and atomized. The atomized liquid enters the mixing chamber at a velocity sufficient to draw in air from the air inlet to mix with the liquid to form a foam.

18 Claims, 17 Drawing Sheets

(56) References Cited

U.S. PATENT DOCUMENTS

| | | | | |
|---|---|---|---|---|
| 8,499,981 | B2 * | 8/2013 | Quinlan et al. | 222/145.5 |
| 2007/0023452 | A1 | 2/2007 | Tseng | |
| 2008/0006656 | A1 | 1/2008 | Tseng | |
| 2009/0188994 | A1 | 7/2009 | Ray et al. | |
| 2009/0200337 | A1 | 8/2009 | Quinlan et al. | |
| 2009/0314806 | A1 * | 12/2009 | Ray | 222/190 |

FOREIGN PATENT DOCUMENTS

| | | |
|---|---|---|
| EP | 2127581 A1 | 12/2009 |
| EP | 2135681 A2 | 12/2009 |

* cited by examiner

VORTEX ATOMIZING FOAM PUMP AND REFILL UNIT UTILIZING SAME

TECHNICAL FIELD

The present invention relates generally to foam pumps and more particularly to inverted vortex atomizing foam pumps and refill units utilizing same.

BACKGROUND OF THE INVENTION

Liquid dispensers, such as liquid soap and sanitizer dispensers, provide a user with a predetermined amount of liquid upon the actuation of the dispenser. It is known to dispense liquids, such as soaps, sanitizers, cleansers and disinfectants from a dispenser housing that uses a removable and replaceable cartridge containing the liquid. In addition, it is sometimes desirable to dispense the liquids in the form of foam by, for example, interjecting air into the liquid to create a foamy mixture of liquid and air bubbles. Foam pumps typically include a liquid pump and an air pump, wherein the air pump is used to force air under pressure, and the liquid pump is used to pump the liquid under pressure into a mixing chamber where the air aerates the liquid thereby creating foam. Vortex foam pumps have been used in upright trigger sprayers; however, these vortex foam pumps are not suitable for use in an inverted position.

SUMMARY

Foam dispensers, refill units for foam dispensers, and liquid pumps for use in foam dispensers are disclosed herein. In one embodiment, a pump for inverted foam dispensing having a connector for connecting the pump to a liquid container. During operation, the connector is located at the top of the inverted pump. The inverted pump includes a compression chamber having an inlet valve and an outlet valve. The compression chamber is in fluid communication with a flow restrictor, an atomizer, a mixing chamber, a foaming chip and an outlet. The outlet is located at the bottom of the inverted pump during operation. The inlet valve, outlet valve, flow restrictor, atomizer, mixing chamber, foaming chip and outlet extend along a common axis that extends vertically. An air inlet is included that extends into the mixing chamber, the air inlet is open to atmospheric pressure. During operation, the liquid pump is located below the liquid container and liquid flowing from the compression chamber is accelerated and atomized. The atomized liquid enters the mixing chamber at a velocity sufficient to draw in air from the air inlet to mix with the liquid to form a foam.

Also provided herein is a refill unit for a foam pump dispenser. The refill unit includes a liquid container and a foam pump connected to the liquid container. The liquid container is located above the foam pump during operation. The foam pump has a central vertical axis and includes an inlet valve, a compression chamber, an outlet valve, a foaming nozzle having a flow restrictor, a rotator, an atomizer, and an air inlet open to atmospheric pressure, and an outlet. The inlet valve, outlet valve, foaming nozzle and outlet extend along the central vertical axis. During operation, the foaming nozzle accelerates the velocity of the liquid, imparts a rotational motion on the liquid, atomizes the liquid and draws in air to mix with the atomized liquid to form a foam that is dispensed out of the outlet.

In addition, a pump having a cap for securing the pump to a liquid container is provided. The pump includes a pump body having an inlet valve and a valve body located at least partially within the pump body. A compression chamber is located within the pump body, the compression chamber compress vertically. The valve body includes a seal for engaging an interior wall of the pump body. There is a first passage between the inlet valve and an interior of the valve body and a second passage from the interior of the valve body to the exterior of the valve body. The valve body includes a surface for engaging a valve seat. A biasing mechanism for biasing the surface of the valve body against the valve seat is also included. During operation, movement of the valve body in a first direction causes liquid to flow past the inlet valve into the valve body and movement in a second direction causes liquid to flow out of the valve body and causes the surface of the valve body to move away from the valve seat and allow fluid to flow out of the pump body.

BRIEF DESCRIPTION OF THE DRAWINGS

In the accompanying drawings which are incorporated in and constitute a part of the specification, embodiments of the invention are illustrated, which, together with a general description of the invention given above, and the detailed description given below, serve to example the principles of the inventions.

DETAILED DESCRIPTION

Figure 1:
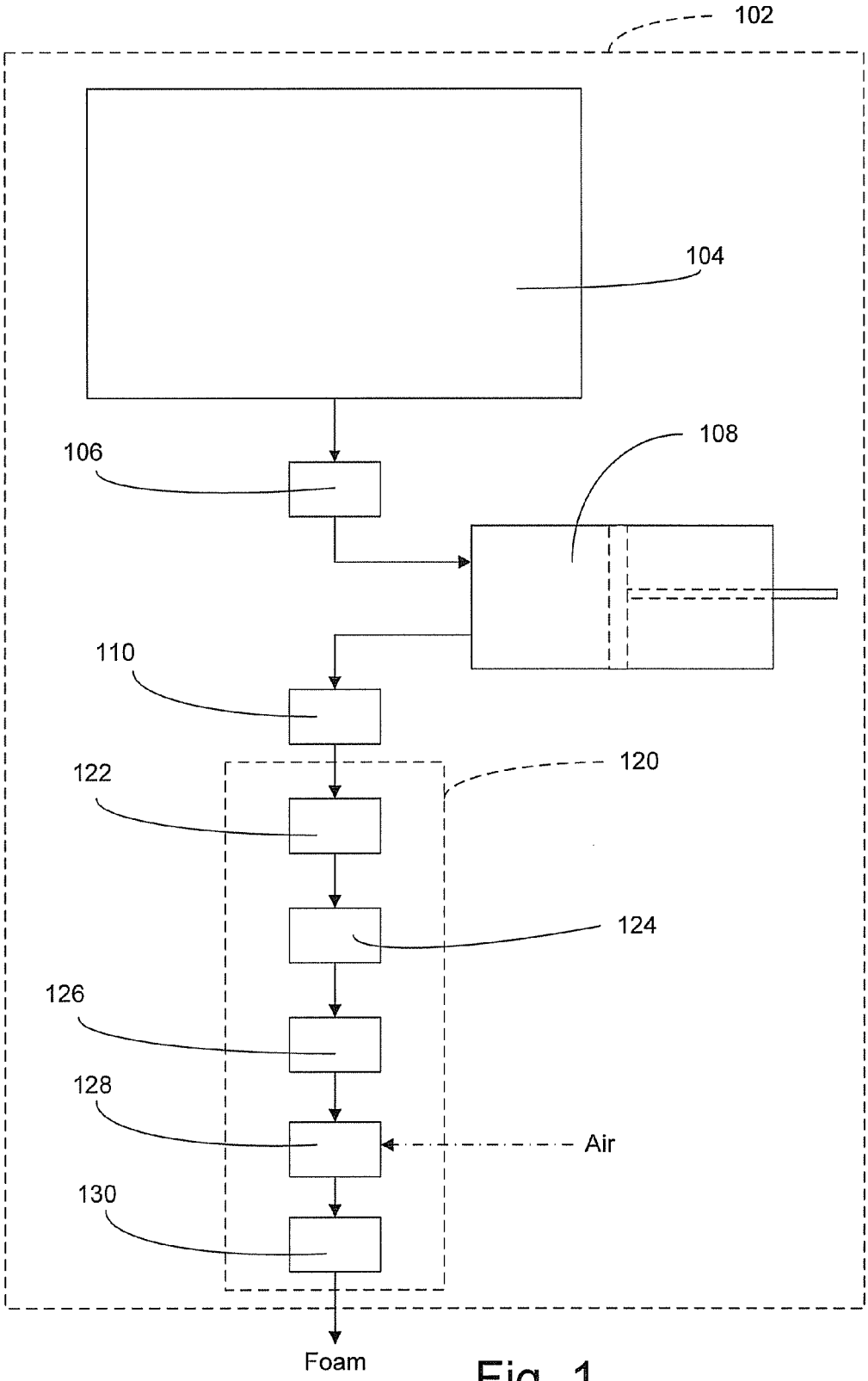
FIG. 1 illustrates a block diagram of an exemplary vortex atomizing foam dispenser system.

FIG. 1 illustrates a block diagram of an exemplary inverted vortex atomizing foam pump dispenser system 100. Atomizing foam pump dispenser system 100 includes a housing 102. Housing 102 includes an actuator (not shown). The actuator may be a manual actuator, such as, for example, a lever or push bar. Optionally, the actuator may be an electronic actuator with a sensor that senses the presence of an object and causes the actuator to dispense a shot of foam. Inside of housing 102 is a refill unit that includes a liquid container 104, an inlet valve 106, a liquid pump 108, an outlet valve 110 and a foaming nozzle 120. During operation, liquid container 104 is located above liquid pump 108 and foaming nozzle 120.

Inlet valve 106 is a one-way valve and may be any type of one-way valve, such as, for example, a mushroom valve, a flapper valve, a plug valve, an umbrella valve, a poppet valve, etc. Inlet valve 106 should have sufficient cracking pressure to prevent liquid from passing by the inlet valve absent a vacuum created downstream of inlet valve 106. Similarly, outlet valve 106 is a one-way valve and can be any type of one-way valve, such as, for example, a slit-valve, a plug valve, an umbrella valve, a poppet valve, etc. Outlet valve 106 must have a sufficient cracking pressure to prevent leaking of liquid from the atomizing foam pump and preferably has a sufficient cracking pressure that allows pressure to build up in the compression chamber, thereby forcing the liquid past outlet valve 106 at a higher velocity. Liquid pump 108 is illustrated as a piston pump, but liquid pump 108 may be any type of liquid pump, such as, for example, a dome pump, a bellows pump or any other device that has a liquid chamber that may be expanded and contracted to move liquid through the refill unit.

In one embodiment, foaming nozzle 120 includes a flow restrictor 122, a liquid rotator 124, an atomizer 126, an air inlet 128 and a foaming chip 130. Air inlet 128 is an opening to air at atmospheric pressure, i.e., no air compressor or air pump is required. Flow restrictor 122 creates an area of reduced cross-section. Fluid flowing past flow restrictor 122 increases in velocity as it is forced through flow restrictor 122. Flow restrictor 122 may be, for example, an orifice that has a smaller diameter than the inlet to the flow restrictor 122, a cylinder in the flow path that reduces the cross-sectional area of the flow path or a similar flow-restricting mechanism.

Liquid rotator 124 imparts rotation on the liquid as the liquid passes through liquid rotator 124 and out of atomizer 126. Atomizer 126 creates a fine mist or spray of droplets that enter into a mixing chamber located in foaming chip 130. The fine mist or spray of droplets travel past air inlet 128 at a velocity that is sufficient to draw air into the foaming chip 130 through a Venturi effect. The air mixes with the spray or mist of droplets and creates a foam that exits foaming chip 130 and is dispensed to a user through the outlet nozzle.

One or more of the components of the foaming nozzle 120, such as, for example, flow restrictor 122, liquid rotator 124, atomizer 126, air inlet 128, and foaming chip 130, may be combined in one unit. In some embodiments, one or more of these components may be left out entirely.

FIGS. 2-5 illustrate an exemplary inverted vortex atomizing foam pump 200 for use in a foam pump dispenser 100. Vortex foam pump 200 includes a cap 202. Cap 202 includes threads 204 for securing vortex foam pump 200 to a liquid container. Cap 202 may be connected to a liquid container through other means, such as, for example, an adhesive or snap-fit connection. Also included is a gasket 206 within cap 202 that is placed in contact with the liquid container (not shown) to form a liquid tight seal between the container and a vortex foam pump 200. Cap 202 includes a bottom lip 301. Bottom lip 301 retains base 208 within cap 202. Base 208 includes inverted annular troughs 302 and 306. In one embodiment, inverted annular troughs 302 and 306 include one or more projections and/or recesses around their interior walls. Pump body 318 includes upstanding projecting members 304 and 308. Upstanding projecting members 304 and 308 fit into inverted annular troughs 302 and 306 respectively. In one embodiment, projecting members 304 and 308 include one or more recesses and/or projections around their upstanding walls that mate with one or more projections and/or recesses around the walls of inverted annular troughs 302 and 306. These mating projections and recesses provide for a snap-fit connection to connect base 308 to pump body 318. Optionally, base 308 and pump body 318 may be connected to one another by other means, such as, for example, an adhesive, thermal welding, or threads. In addition, base 208 has a cylindrical opening 210 therethrough. A tapered end wall of cylindrical opening 210 serves as a valve seat 211 for one-way inlet valve 212.

Pump body 318 includes cylindrical inlet opening 320; plate 228 with apertures 322 therethrough; cylindrical housing 218 that forms a portion of compression chamber 332; aperture 330 provides a path for the liquid between cylindrical inlet opening 320 and compression chamber 332; a cylindrical outlet opening 325, and a valve seat 324. A valve basket 216 fits within cylindrical inlet opening 320. Valve basket 216 includes an aperture 217 to allow liquid that enters valve basket 216 to continue to flow through pump body 318. One-way inlet valve 212 and biasing member 214 fit at least partially within valve basket 216. One-way inlet valve 212 is illustrated as a poppet valve; however, as discussed with respect to FIG. 1, many types of one-way inlet valves may be used. Once base 308 is secured to pump body 318, one-way inlet valve 212, biasing member 214 and valve basket 216 are secured within vortex foam pump 200.

Cylindrical housing 218 includes a threaded portion 340. End cap 220 has a threaded portion 221 for connecting to cylindrical housing 218. End cap 220 secures a piston assembly 223 (wiper seal 224 and plunger 222) to cylindrical housing 218. Plunger 222 is connected to wiper seal 224 by projection member 222A engaging with aperture 225 in wiper seal 224. In one embodiment, a biasing member, such as, for example, spring 342, is placed inside of cylindrical housing 218 to urge wiper seal 225 to its outermost position which results in compression chamber 332 being expanded to its largest volume. Optionally, plunger 222 is connected to an actuating mechanism (not shown) that pulls plunger 222 and wiper seal 225 back to its outermost position.

In addition, pump body 318 includes a cylindrical outlet opening 323 having a wall 325. The upper end of cylindrical outlet opening 323 has tapered walls that form a second valve seat 324. One-way outlet valve 230 contacts valve seat 324 to prevent liquid from traveling upward into pump body 318. One-way outlet valve 230 is shown as a poppet valve but, as discussed with respect to FIG. 1, outlet valve 230 may be any type of one-way outlet valve. One-way outlet valve 320 is biased to a closed position by a biasing member, such as, for example, spring 232. The lower outside portion of the cylindrical outlet opening 323 includes threaded portion 336.

A foaming nozzle 350 that includes a housing 239, restrictor 242, liquid rotator 240, and foaming chip 250 is secured to the pump body 318. When foaming nozzle 350 is secured to pump body 318, one-way outlet valve 230 and biasing member 232 are retained within vortex foam pump 200. Foaming nozzle 350 is described in more detail with respect to FIGS. 4-7 below.

Figure 4:
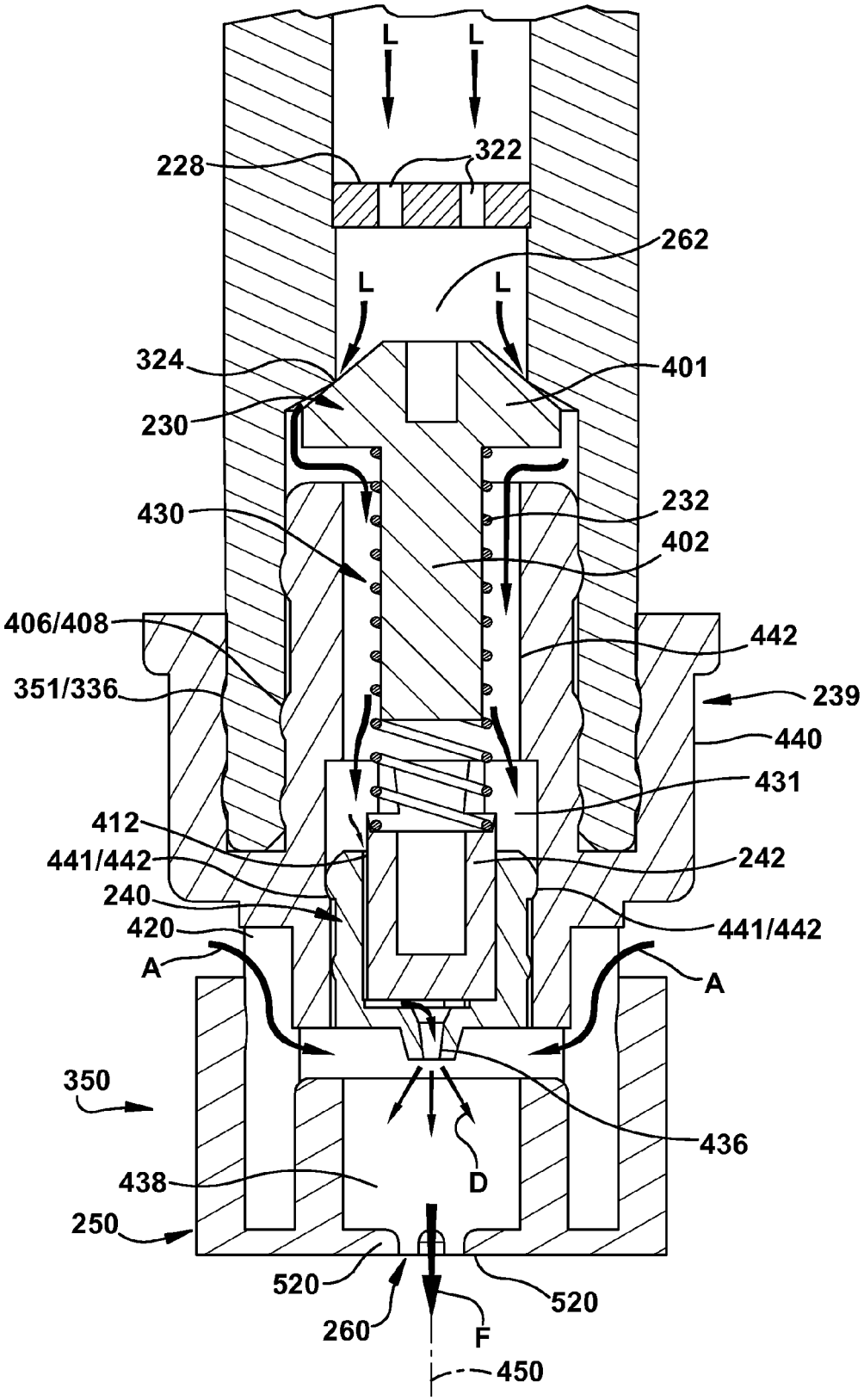
FIG. 4 is an enlarged cross-section of an exemplary embodiment of a foaming nozzle secured to the end of the vortex foam pump of FIG. 2.

FIG. 4 is an enlarged cross-section of an exemplary embodiment of foaming nozzle 350 secured to the end of pump housing 318. The end of pump housing 318 includes one or more recesses and/or protrusions 366 for securing foaming nozzle 350 thereto. Foaming nozzle 350 includes housing 239 that has one or more mating protrusions and/or recesses 351 for securing the foaming nozzle 350 to the end of pump housing 318. Accordingly, foaming nozzle 350 may be secured to pump housing 318 by a snap-fit connection. Although many of the parts are described herein as being securing to one another by a certain type of connection, such as a snap-fit connection or a threaded connection, they may be secured to one another by other means, such as, for example an adhesive, a threaded connection, snap-fit or thermal welding even though specific embodiments may not have been described as being secured to one another in each of these manners.

Housing 239 includes an inlet passage 430. Inlet passage 430 has a diameter that is larger than valve stem 402 and biasing member 232. A restrictor 242 is located in center of housing 239. Restrictor 242 has a cylindrical shape with a closed off bottom. Restrictor 262 may have an open center portion, as shown, or may be solid. Restrictor 262 is an integral part of housing 239 and is held in the center by protrusions 503. Optionally, restrictor 262 may be separate from housing 239. Between protrusions 503 are openings 502, that allow fluid to flow past restrictor 262 into an intermediate passage 431. The outside wall 506 of housing 239 in the proximity of intermediate passage 431 has a diameter that is greater than the diameter of inlet passage 430.

Located in the outside wall 506 are one or more additional recesses and/or projections 442. Rotator 240 includes one or more mating protrusions and/or recesses 441 for securing rotator 240 to housing 249. Accordingly, rotator 240 may be secured to housing 239 with a snap-fit connection. This connection is a liquid tight connection that does not allow fluid to flow between rotator 240 and outside wall 506. All of the liquid L must flow between rotator 240 and restrictor 242. Rotator 240 includes an outlet tip 436. Preferably outlet tip 436 has an outside diameter of 1.2 mm and extends a distance of a ratio of ½ (half) the diameter, or 0.6 mm, below the bottom of rotator 240. The tolerances identified here are applicable for all of the outlet tips of the rotators in all of the embodiments described herein. Rotator 240 is described in more detail with respect to FIGS. 5 and 6. When assembled rotator 240 at least partially surrounds restrictor 242.

Housing 239 includes one or more cylindrical projecting member(s) 514 extending downward below rotator 240. There is a space between the one or more projecting member(s) 514 creating one or more openings 521 for air to flow through. Optionally, projecting member 514 may be a cylindrical projecting member with one or more apertures (not shown) therethrough to allow for the passage of air. Cylindrical projecting member 514 includes one or more recesses and/or projections 522. Foaming chip 250 includes an annular recess 526 having one or more mating projections and/or recesses 524 so that foaming chip 250 may be slipped over cylindrical projecting member(s) 514 and secured to housing 239 by a snap-fit connection. Foaming chip 250 includes a mixing chamber 438 and a screen 720.

Figure 5:
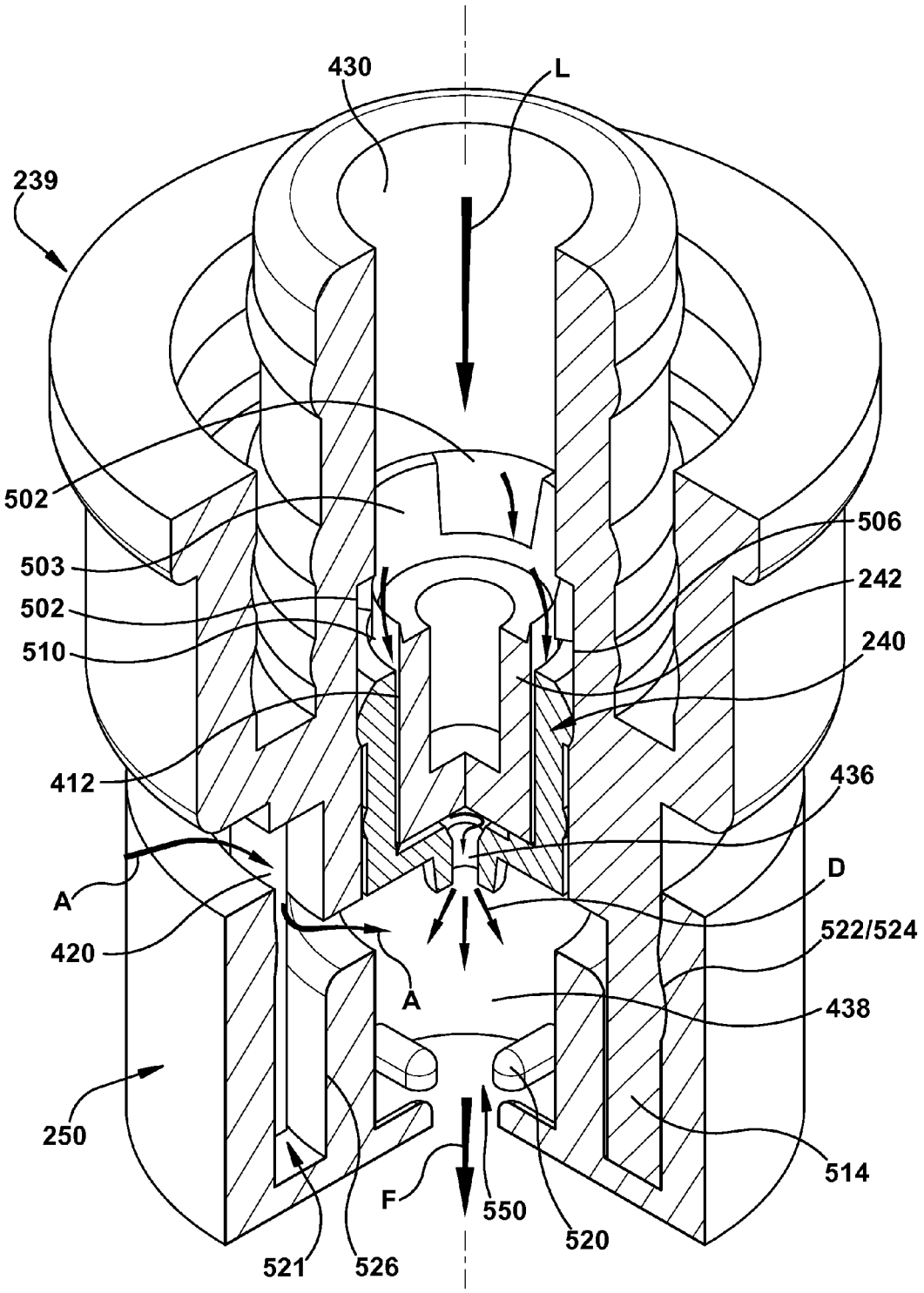
FIG. 5 is another enlarged cross section of the foaming nozzle of FIG. 4.
Figure 6:
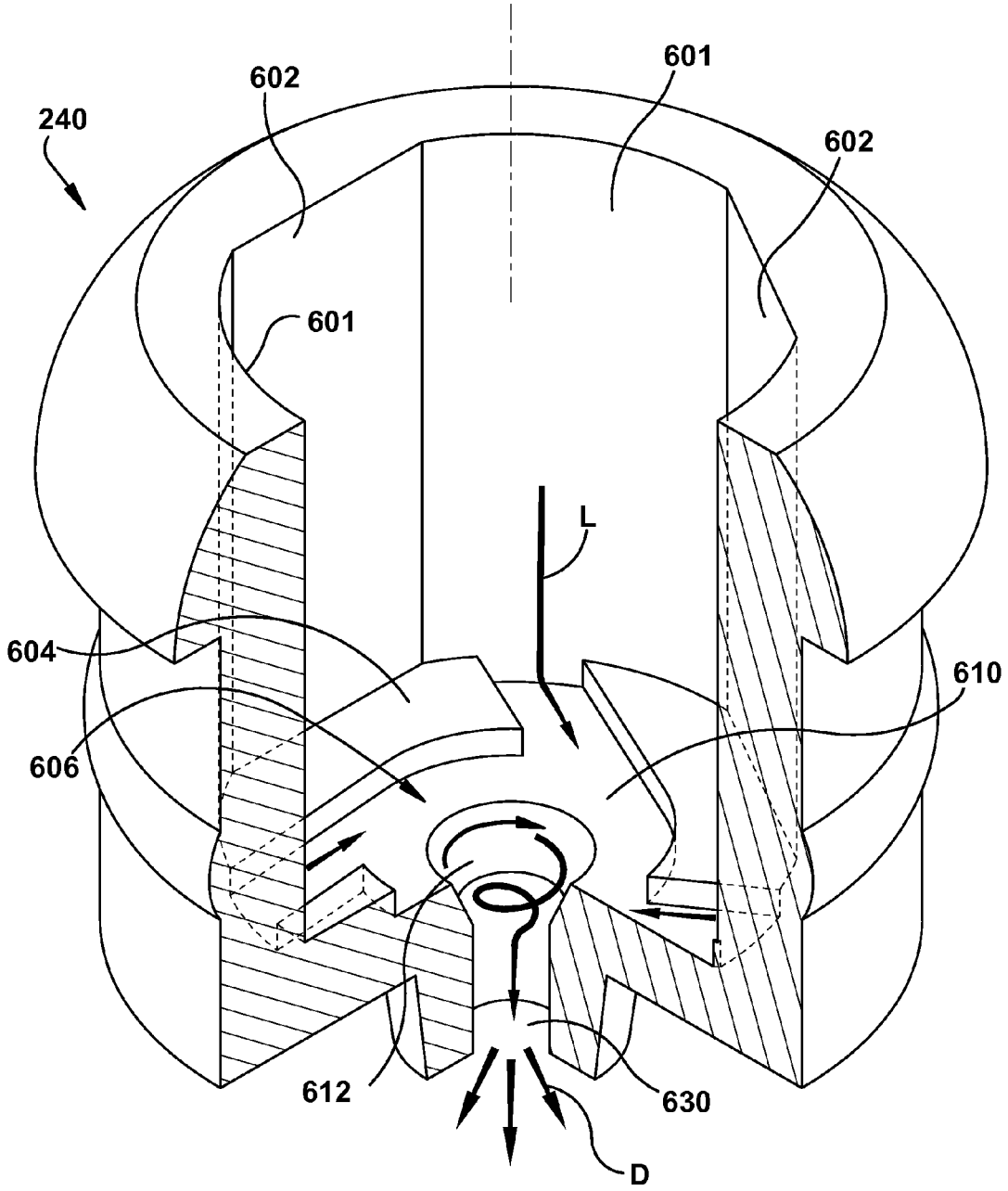
FIG. 6 is an enlarged cross-section of a rotator of the foaming nozzle of FIG. 2.

FIG. 6 illustrates an exemplary embodiment of rotator 242. Rotator 242 includes a cavity having a plurality of side walls 601, 602 and a bottom 604. In one embodiment, walls 601 are curved and walls 602 are straight. When rotator 240 is connected to housing 239, extrusion passages 510 are formed between wall 601 and the outer surface of the restrictor 242 (FIG. 5). Channels 610 are formed in the bottom 604 of rotator 240 and are configured to receive the liquid L from the extrusion passages 510. Further, the channels 610 are shaped and configured in a swirl pattern to cause the liquid L to rotate. In one embodiment, the channels 610 are tangential to a bowl-shaped inlet 612. Bowl-shaped inlet 612 is sloped to outlet opening 630. The rotating liquid L rotates about the bowl-shaped inlet 612 and is forced through the outlet opening 630. In one embodiment, the extrusion passages 510 and rotator 240 are configured to accelerate the liquid L such that the liquid exits the opening 630 at velocity of about 1 m/s.

In one embodiment, the opening 630 is conical in shape and has an outlet diameter of about 0.02 inch. As the liquid L flows through the opening 630, the liquid L is atomized, i.e. converted into a fine mist/spray or small droplets D. In this regard, the opening 630 acts as an atomizer nozzle. The fine spray of liquid D is delivered into a mixing chamber 438 of the foaming chip 250. The fine spray of liquid D creates eddy currents, or a pressure differential, which draws air A into the mixing chamber 438.

Figure 7:
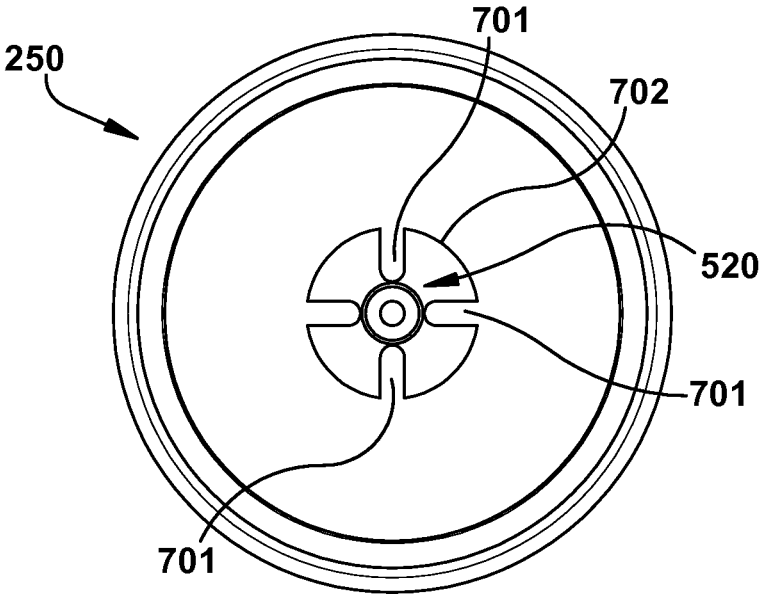
FIG. 7 is a plan view of a foaming chip for the foaming nozzle of FIG. 2.

The foaming chip 250 includes the mixing chamber 438, an air passage 420, a screen 520, and an outlet 550. The air passage 420 is formed between the foaming chip 250 and the housing 239. As illustrated in FIG. 7, the screen 520 of the foaming chip 250 includes a plurality of members 701 extending radially inward from the circumference of a circular opening 702. In one exemplary embodiment, the plurality members 701 are shaped and configured such that open area of the screen 520 is about 80% of the area of the circular opening. As the fine spray of liquid D contacts and/or passes through screen 520, the screen 520 causes the liquid D to slow down and allows the air A to catch up with the liquid D, which causes the liquid D and air A to mix together to form a foam F.

Figure 2:
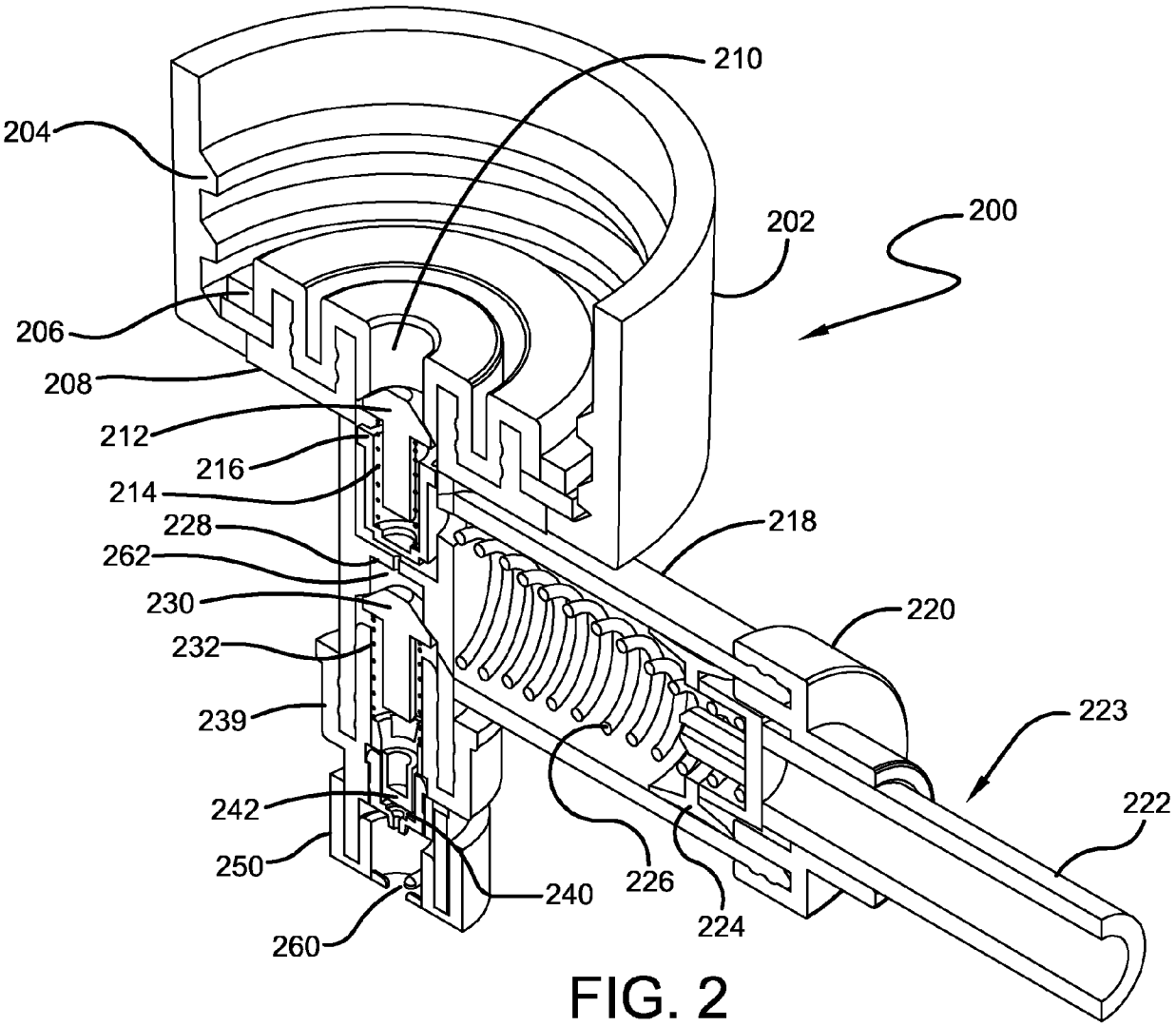
FIG. 2 is a cross-sectional view of an exemplary vortex foam pump.
Figure 3:
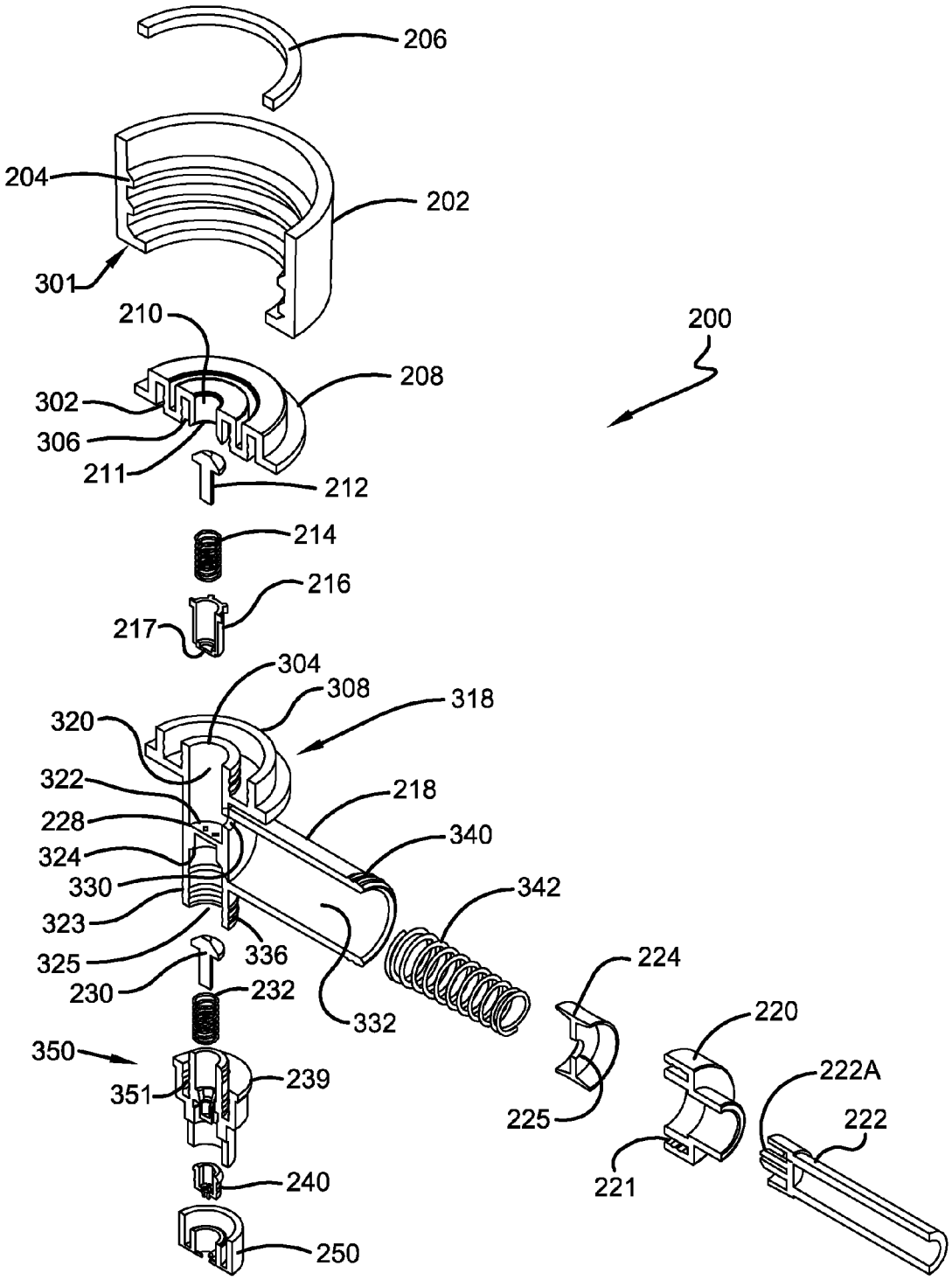
FIG. 3 is an exploded cross-sectional view of the vortex foam pump of FIG. 2.
Figure 8:
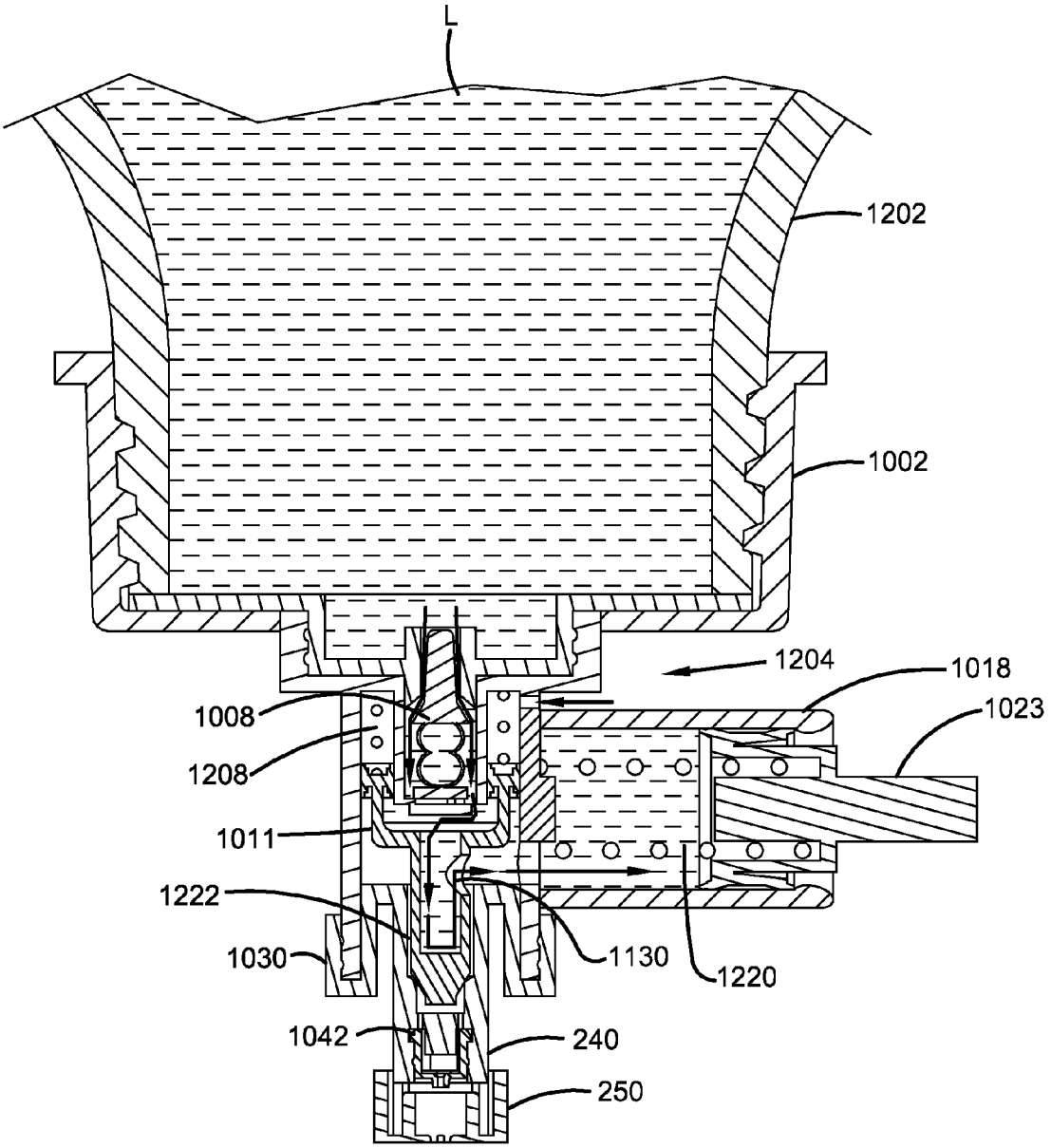
FIG. 8 is a cross-sectional view of the exemplary vortex foam pump of FIG. 2 charged with a liquid.

FIG. 8 is a cross-sectional view of the exemplary vortex foam pump of FIGS. 2 and 3 charged with a liquid. As piston assembly 223 is pulled backward, one-way outlet valve 230 seals against seat 324. Compression chamber 332 expands, one-way inlet valve 212 opens and liquid L flows past one-way inlet valve 212 through aperture 228 and into compression chamber 332.

Figure 9:
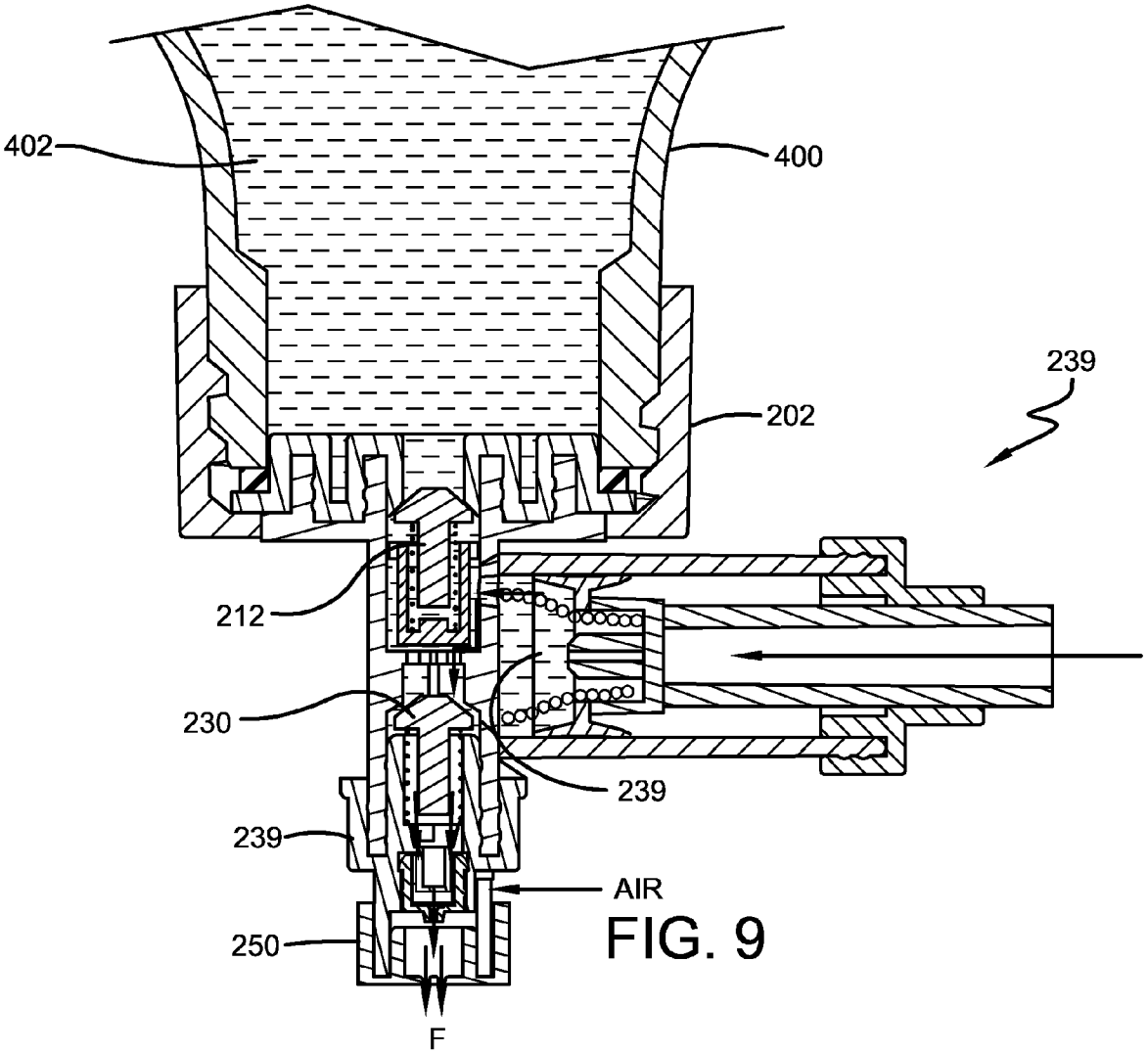
FIG. 9 is a cross-sectional view of the exemplary vortex foam pump of FIG. 2 in a discharged position.

FIG. 9 is a cross-sectional view of the exemplary vortex foam pump of FIG. 2 in a discharged position. As piston assembly 223 is moved forward, one-way inlet valve 212 seals against valve seat 211. Liquid flows out of compression chamber 332 through aperture 228, around and/or through valve basket 216. As best seen in FIGS. 4-6, the liquid L flows through apertures 322 into a staging area 262 formed between the valve head 401 and plate 228. As liquid L enters the staging area 262, pressure builds and the valve head 401 is moved longitudinally away from the valve seat 324 breaking the seal between the valve head 401 and the valve seat 324. The liquid L flows between the valve head 401 and the valve seat 324 and into passage 430. When the pressure of the liquid L in the staging area 262 is reduced (e.g., the flow of liquid L from the liquid pump is reduced or shut off), biasing member 232 forces the valve head 401 back to the closed position against valve seat 324. Although biasing member 232 is shown as a spring, other types of biasing members may be used.

The liquid L flows into passage 430, passage 431, through opening(s) 502 and into one or more extrusion passages 510 that are located between the outer surface of flow restrictor 242 and rotator 240. These extrusion passages 510 are configured to restrict the flow of the liquid L and increase the velocity of the liquid L. The flow restriction may be adjusted by increasing or decreasing the cross-sectional area of extrusion passages 510.

As the liquid L travels through extrusion passages 510, the velocity of the liquid L increases. The liquid L flows into channels 610, which are tangential to bowl-shaped inlet 612, where a spinning or rotational motion is imparted to the stream of liquid L. In one embodiment, the rotational motion further accelerates the liquid L. The rotating liquid L travels through outlet passage 630 where it is atomized into a fine spray of droplets D and sprayed into mixing chamber 438.

The velocity of the atomized droplets D causes an area of low pressure to be formed in mixing chamber 438. The area of low pressure formed within the mixing chamber 438 creates a vacuum that draws in external air A (i.e., the Venturi effect). The air A travels through the air passage 420 and into the mixing chamber 438. The air A mixes with the fine spray of liquid droplets D in the mixing chamber 438 to form a foamy mixture of liquid and air. The mixture passes through screen 520 to create a foam F that is dispensed out of the outlet 550 of the foaming chip portion 250.

Figure 10:
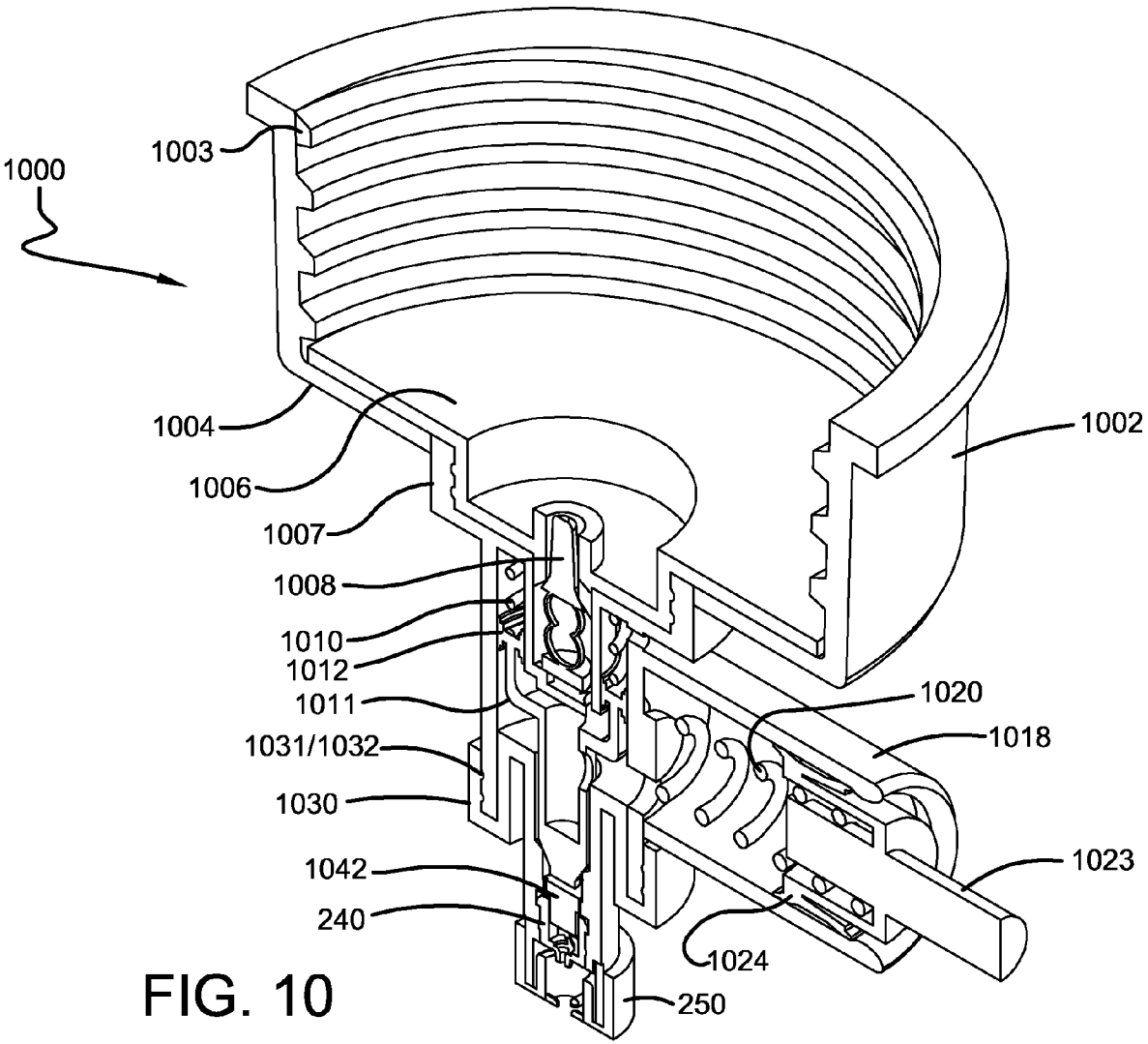
FIG. 10 is a cross-sectional view of another exemplary vortex foam pump.
Figure 11:
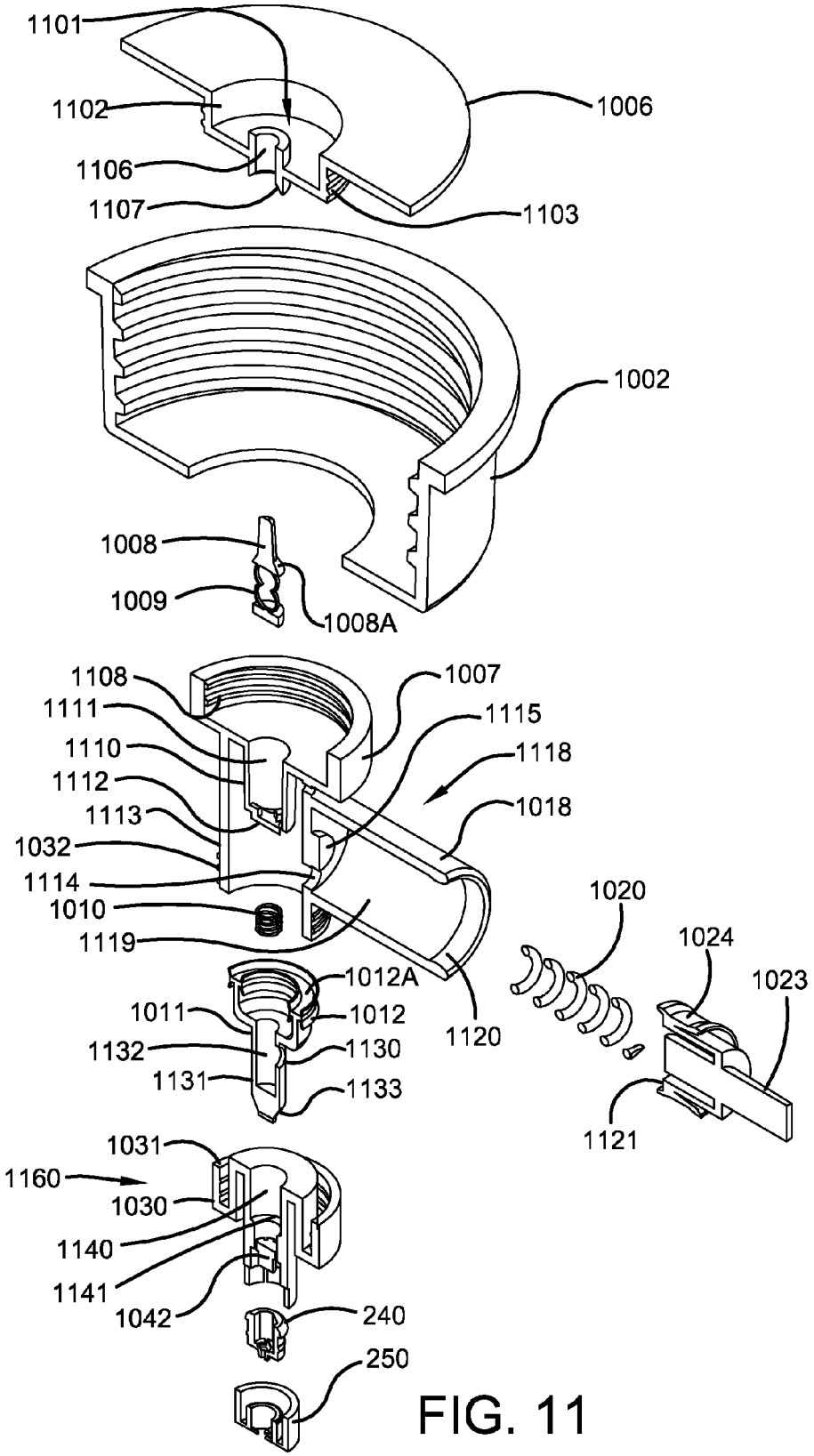
FIG. 11 is an exploded cross-sectional view of the exemplary vortex foam pump of FIG. 10.

FIGS. 10 and 11 illustrate another exemplary vortex foam pump 1000. Vortex foam pump 1000 includes a cap 1002 having threads 1003 for connecting to a liquid container (not shown). A gasket (not shown) may be used to seal between the liquid container and cap 1002. Cap 1002 also includes a bottom 1004 having an opening therethrough. Bottom 1004 supports base 1006. Base 1006 includes a depression 1101 located in the center that fits through the opening in bottom 1004. Depression 1101 has a wall 1102. Located about the circumference of wall 1102 is a threaded portion 1103. Base 1006 has a cylindrical inlet 1106 located in the center of depression 1101. Cylindrical inlet 1106 includes a sloped surface on its lower end that serves as a valve seat 1107.

Pump body 1118 includes a collar 1007 that has a threaded portion 1108 located on the interior thereof. Threaded portion 1108 secures pump body 1118 to thread 1103 on base 1006. Pump body 1118 has a cylindrical inlet opening 1111 that has side wall 1110 and a passageway 1112 therethrough. Inlet valve 1008 fits at least partially within inlet opening 1111 and has a valve head 1008A. Valve head 1008A is biased against valve seat 1107 by biasing member 1010. Biasing member 1010 is an elastic member integrally formed with valve 1008. Optionally, biasing member 1010 may be separate from valve 1008. Valve head 1008A has sloped walls that form a seal against valve seat 1107 and prevent liquid from flowing up from pump body 1118 back into the liquid container (not shown). The lower end of valve 1008 rests on the base of cylindrical inlet opening 1111 but does not block passageway 1112.

Pump body 1118 includes a cylindrical body 1113 and a cylindrical housing 1018 for compression chamber 1119. An aperture 1114 connects cylindrical body 1113 to compression chamber 1119. Cylindrical housing 1018 includes a retaining ring 1120 that retains piston 1023 within cylindrical housing 1018. Piston 1023 includes wiper seal 1024. In addition, wiper seal 1024 includes an annular trough 1121. One end of biasing member 1020 fits within annular trough 1121. The other end of biasing member 1020 fits over projection 1115. Accordingly, when piston 1023 is inserted into cylindrical housing 1018, biasing member 1020 is held in position to bias piston 1023 to its outermost position, in which compression chamber 1119 is at its largest volume.

Figure 12:
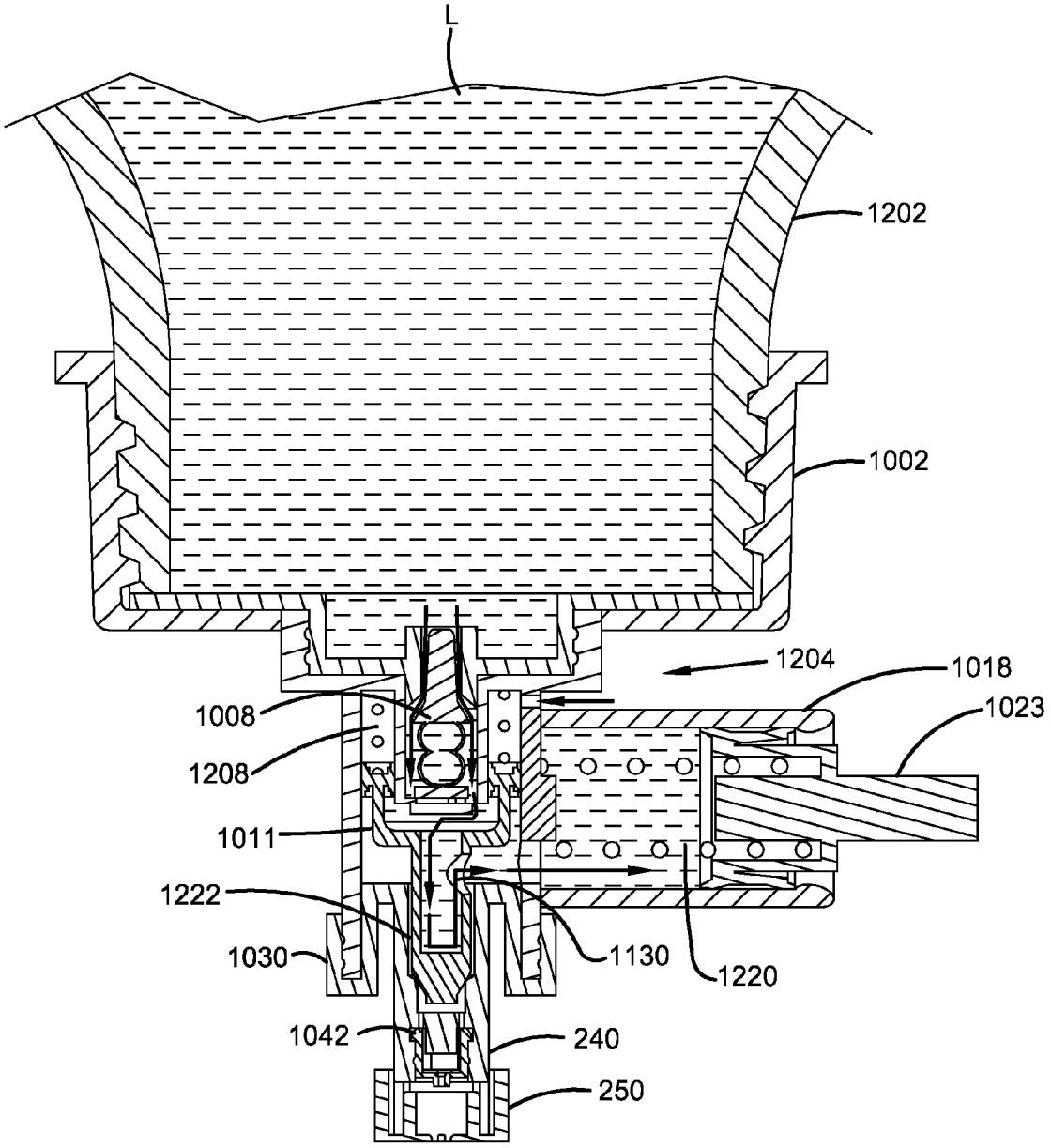
FIG. 12 is a cross-sectional view of the exemplary vortex foam pump of FIG. 10 charged with a liquid.

Valve body 1011 fits within cylindrical body 1113. Valve body 1011 includes a wiper seal 1012 that contacts the inside wall of cylindrical body 1113. Wiper seal 1012 prevents liquid from passing up and out through air hole 1204 (FIG. 12). Air hole 1204 allows air to enter and exit the area of cylindrical body 1113 above wiper seal 1012 to prevent creating a vacuum lock that prevents valve body 1011 from moving up and down. Wiper seal 1012 includes an annular recess 1012A for receiving biasing member 1010, which may be, for example, a spring. The upper portion of biasing member 1010 fits around a cylindrical inlet opening to secure biasing member 1010 in place. Valve body 1011 includes a cylindrical center open portion 1032 that is defined at least in part by cylindrical wall 1131. A liquid inlet opening 1130 is included in wall 1131 which allows liquid to pass through valve body 1130. In addition, valve body 1011 includes a tapered bottom portion 1133. Pump body 1118 also includes a threaded portion 1032 on cylindrical body 1113 for receiving foaming nozzle 1160.

Foaming nozzle 1160 is similar to foaming nozzle 350. Foaming nozzle 1160 includes housing 1030 with a threaded portion 1031 for connecting to threaded portion 1032 of pump body 1118. Housing 1030 includes an inlet opening 1140 that receives valve body 1011. The outside diameter of the cylindrical wall 1131 is slightly smaller than the diameter of inlet opening 1140. Accordingly, small passageway 1222 (FIG. 12) is formed between cylindrical wall 1131 and inlet opening 1140. This small passageway 1222 forms a restrictor, and in one embodiment, no other restrictor is required. Housing 1030 also includes a restrictor 1042 that is substantially similar to restrictor 242. In addition, housing 1030 includes a tapered ridge located within cylindrical opening 1140. The tapered ridge forms a valve seat 1141. When assembled, biasing member 1010 urges valve body 1011 downward and the tapered bottom portion 1133 of valve body 1011 presses against valve seat 1141 and forms a one-way outlet valve. Foaming nozzle 1160 includes a rotator 240 and a foaming chip 250, which are discussed in detail above.

Figure 13:
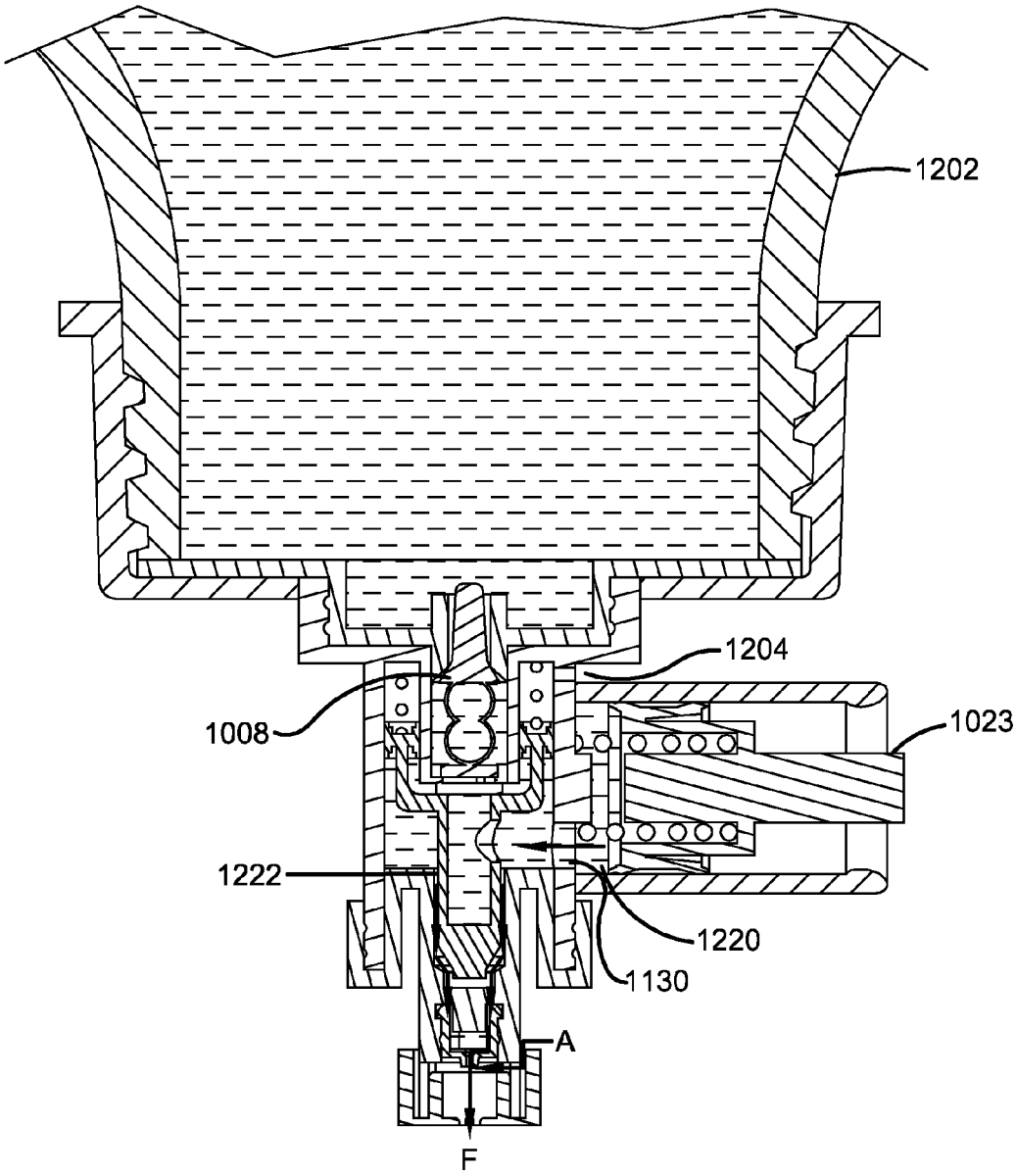
FIG. 13 is a cross-sectional view of the exemplary vortex foam pump of FIG. 10 in a discharged position.

FIGS. 12 and 13 illustrate the vortex foam pump 1000 in operation. As plunger 1023 is moved toward its outermost position and compression chamber 1220 is expanded, a vacuum is created. Valve body 1011 is biased to a closed position until enough of a vacuum is created to overcome the cracking pressure of inlet valve 1008, allowing liquid L to be drawn into cylindrical opening 1111 and through passage 1112 into valve body 1011. The liquid L flows through valve body 1011 through aperture 1130 and into compression chamber 1220.

As plunger 1023 is moved toward its innermost position, the volume of compression chamber 1220 is reduced and pressure builds up in pump body 1113. Inlet valve 1008 is pushed into a sealing position preventing liquid L from flowing back up into liquid container 1202. Accordingly, liquid is forced to flow through passage 1222 located between the outside wall 1131 and cylindrical opening 1140 and lifts tapered portion 1133 of valve body 1011 off of valve seat 1141. When valve body 1011 is lifted, air may pass through opening 1204 to prevent air pressure building up above valve body 1011 and preventing valve body 1011 from moving up. As described in detail above, the liquid then flows between restrictor 1042 and rotator 240, where the speed of the liquid L is accelerated, rotated and atomized into a fine mist of droplets D as it flows into the mixing chamber in foaming chip 250. Air is drawn into the foaming chip 250 through a venturi effect, mixes with the atomized liquid droplets D and is expelled as a foam.

Figure 14:
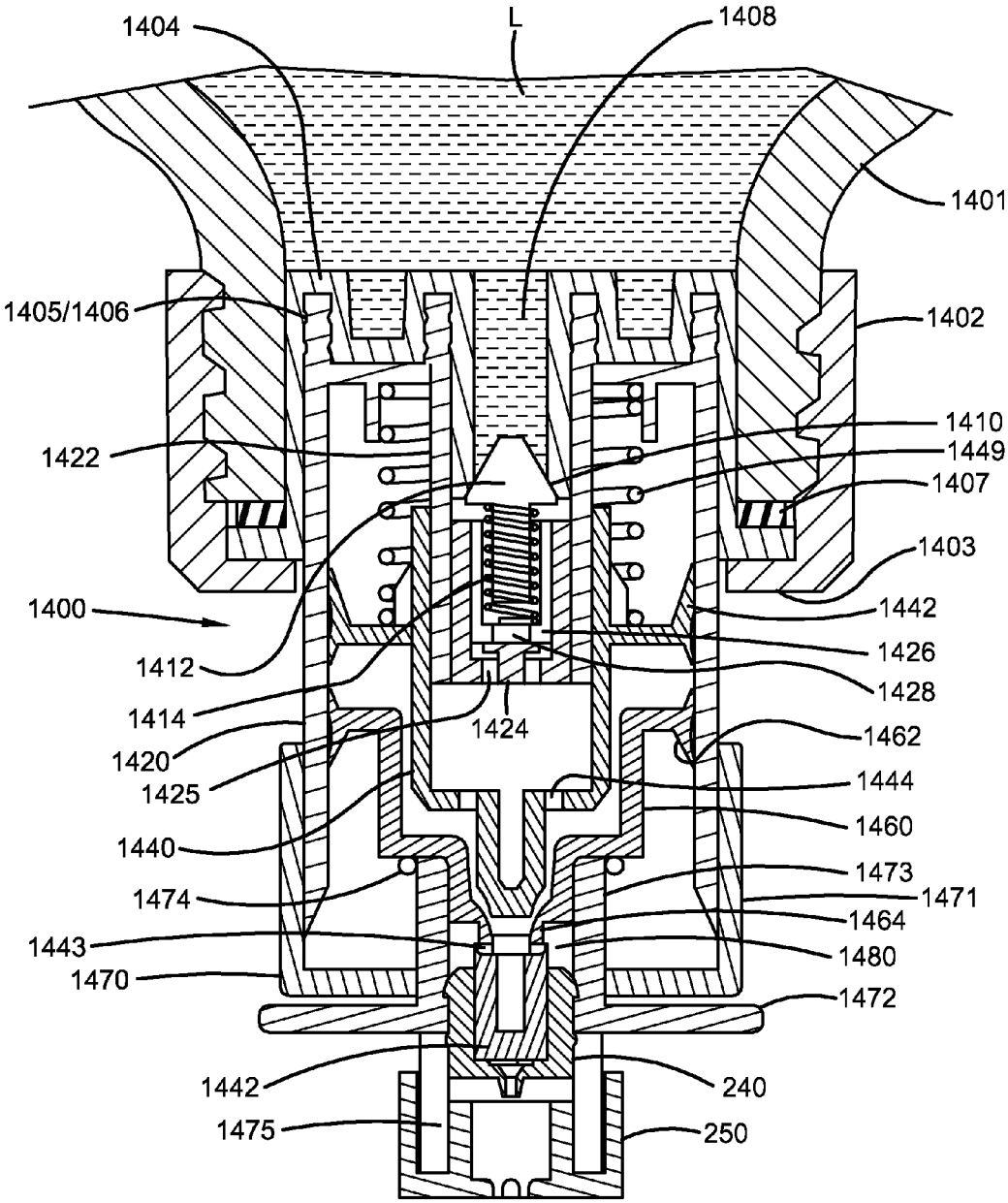
FIG. 14 is a cross-sectional view of another exemplary vortex foam pump.

FIG. 14 is a cross-sectional view of another exemplary inverted vortex foam pump 1400. Vortex foam pump 1400 includes a cap 1402 which is connected to a liquid container 1401 with a threaded connection. Cap 1402 has a flange 1403 that supports upper housing 1404. A gasket 1407 is located between liquid container 1401 and upper housing 1404 to provide a liquid tight seal between vortex foam pump 1400 and liquid container 1401. Upper housing 1404 includes one or more projections and/or recesses 1405 that mate with one or more recesses and/or projections 1406 located on pump body 1420 to provide a snap-fit connection between pump body 1420 and upper housing 1404. Upper housing 1404 includes a center cylindrical inlet opening 1408. The lower surfaces of the walls of the upper housing 1404 that form center cylindrical inlet opening 1408 are tapered and form an inlet valve seat 1410. Pump body 1420 includes a central cylindrical portion 1422 having a base 1424 with one or more passages 1425 therethrough. Valve basket 1426 sits on base 1424. Valve basket 1426 has an opening 1428 therethrough that is in fluid communication with the one or more passages 1425 through base 1424.

A first valve body 1440 is located within pump body 1420 and has a cylindrical wiper seal 1426 that rides up and down on the interior wall of pump body 1420 and prevents liquid L from entering into the area where biasing member 1449 is located. First valve body 1440 has one or more apertures 1444 therethrough. In addition, first valve body 1440 has a bottom portion 1446 that has tapered side walls. The tapered side walls of bottom portion 1446 are configured to engage tapered walls of second valve body 1460, which acts as valve seat 1464. First valve body 1440 is biased in the downward position by biasing member 1449 and tapered side walls of bottom portion 1446 act as a one-way outlet valve. Second valve body 1460 includes cylindrical wiper seal 1462 that also rides up and down on the interior wall of pump body 1420. Biasing member 1449 biases both first valve body 1440 and second valve body 1460 toward their downward-most positions.

End cap 1470 includes an upstanding cylindrical projection member 1471 that fits over the outside wall of pump body 1420. End cap 1470 may be secured to pump body 1420 by any means such as for example, a snap-fit connection, a thermal welded connection, a threaded connection, an adhesive, or a friction fit connection. End cap 1470 has an opening in which cylindrical housing 1473 fits through. Cylindrical housing 1473 includes one or more projecting members 1474 that may be forced through the opening in end cap 1470 during assembly, but retains housing 1473 in end cap 1470 during normal use. Housing 1473 also includes a plurality of downward projection members 1475 for connecting to foam chip 250 that are substantially similar to the downward projection members 514 discussed above. Housing 1473 includes actuation member 1472 that may be used by an actuator (not shown) to actuate vortex foam pump 1400. In addition, as discussed above, housing 1473 includes recesses and/or projecting members to allow rotator 242 to connect to housing 1473 with a snap-fit connection. Restrictor 1442 is integrally formed with second valve body 1460 and includes apertures 1443 to allow liquid to enter passage 1480. Optionally, restrictor 1442 may be a separate part and merely sit inside rotator 242. Foaming chip 250 is described in detail above.

The inverted vortex foam pump 1400 draws in ambient air to create foam. Accordingly, a separate air compressor or air pump is not needed to create a foam. Eliminating the air compressor portion allows the inverted vortex foam pump to be smaller in size than current foam pumps that include an air compressor portion. In one embodiment, vortex foam pump 1400 has a closure diameter of no greater than 1.25 inches. Closure diameter is the outside diameter of the largest portion of pump. In one embodiment, vortex foam pump 1400 has an output of 0.75 ml. with a closure diameter of 1.06 inches.

Figure 15:
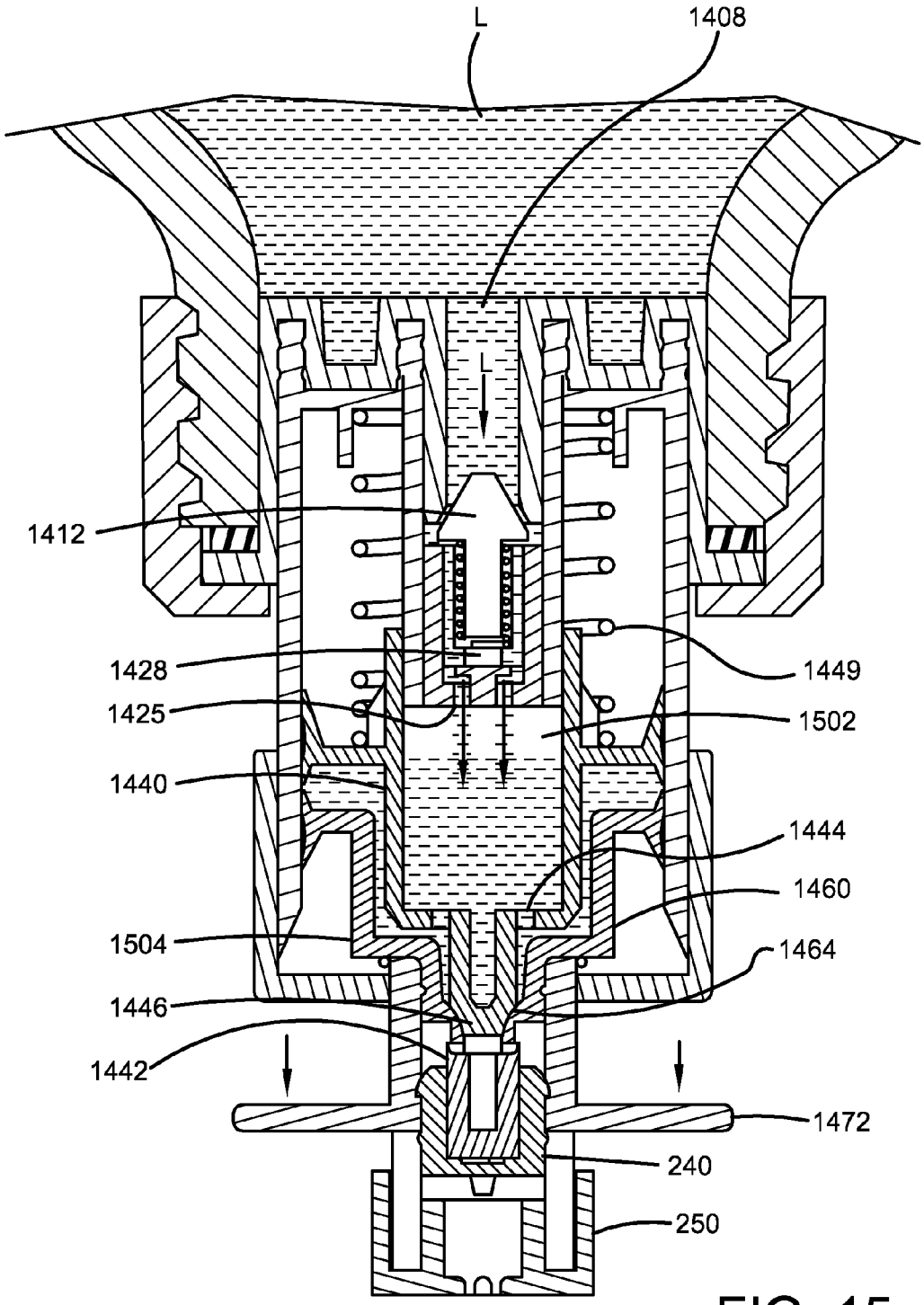
FIG. 15 is a cross-sectional view of the exemplary vortex foam pump of FIG. 14 charged with a liquid.
Figure 16:
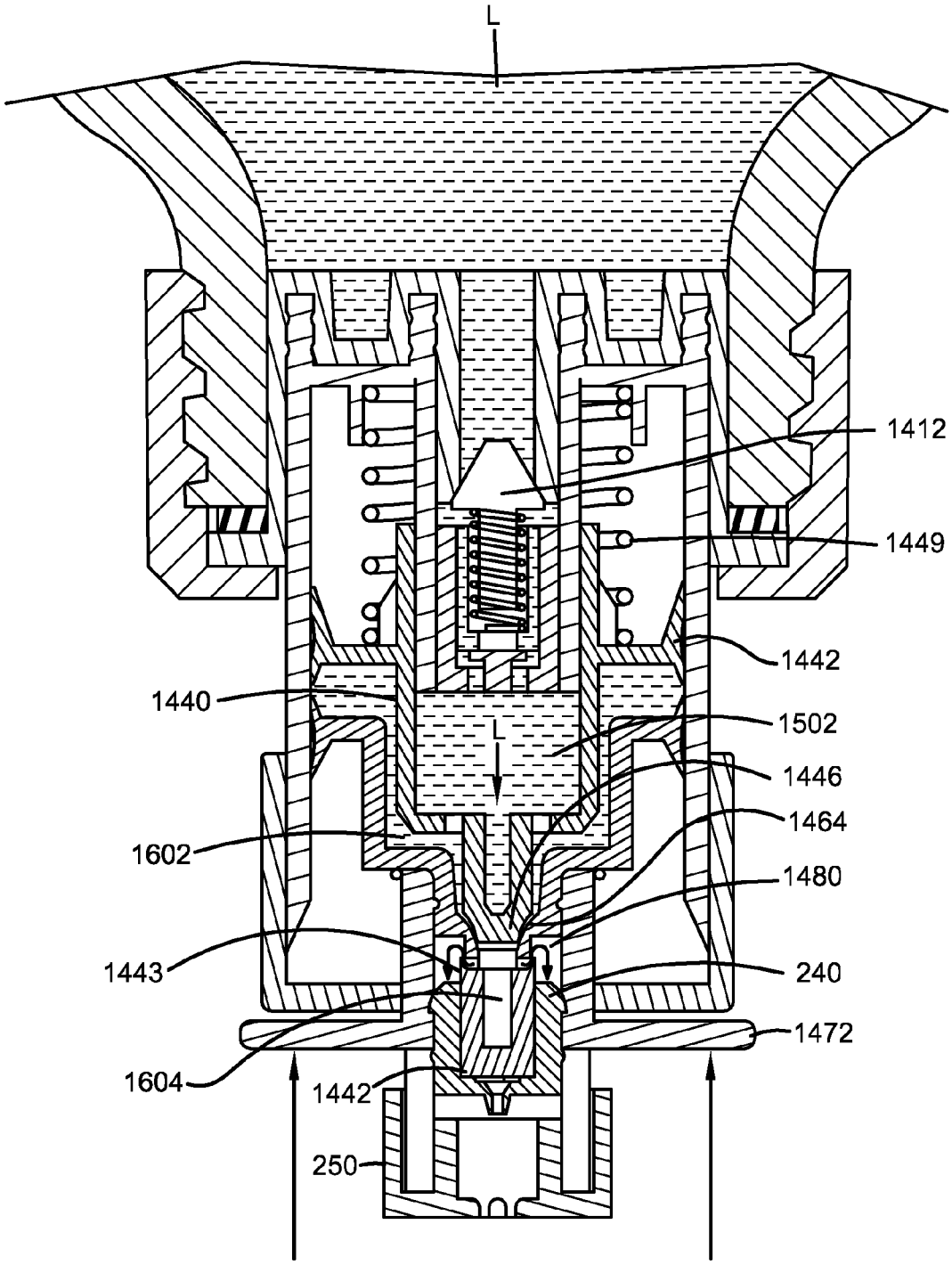
FIG. 16 is a cross-sectional view of the exemplary vortex foam pump of FIG. 14 in a discharged position.

FIGS. 15 and 16 illustrate the vortex foam pump 1400 in operation. As illustrated in FIG. 15, when actuation member 1472 is pulled down, first valve body 1440 moves downward due to biasing member 1449, which expands compression chamber 1502. Because biasing member 1449 urges first valve body 1440 downward, the tapered walls of end portion 1446 seal against valve seat 1464. When the vacuum pressure exceeds the cracking pressure of inlet valve 1412, liquid L flows in from inlet 1408 past inlet valve 1412, through opening 1428 in valve basket 1426, or around valve basket 1426, through passage 1425 and into compression chamber 1502. In addition, some of the liquid L may flow through openings 1444 in first valve body 1440 into passage 1504.

As illustrated in FIG. 16, when actuator 1472 is moved upward, pressure is created by compression chamber 1502. Compression chamber 1502 compresses vertically. The pressure forces inlet valve 1412 into seat 1410 and prevents liquid L from flowing into liquid container 1401. The pressure causes first valve body 1440 to move upward and the tapered walls of end portion 1446 lift off of valve seat 1464 to allow liquid L to flow along path 1602 past the tapered walls of end portion 1446 and into passage 1604. The liquid L flows out of passage 1604 through openings 1443 into passage 1480. Once in passage 1480, the liquid is forced between restrictor 1442 and rotator 240 where the speed of the liquid L is accelerated, rotated and atomized into a fine mist of droplets D as it flows into foaming chip 250 where air is drawn into the foaming chip 250, mixes with the atomized liquid droplets D and is expelled as a foam.

Figure 17:
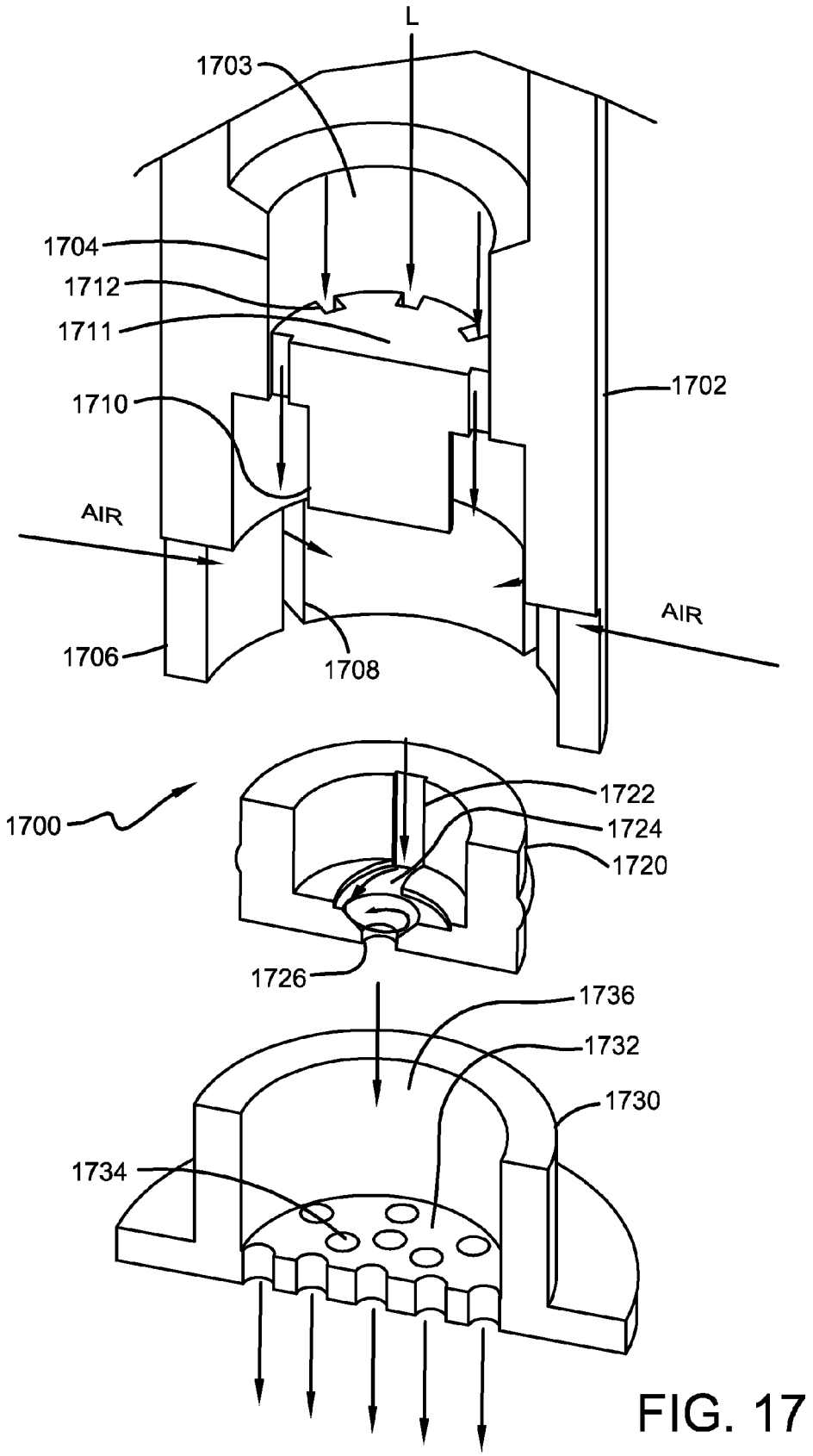
FIG. 17 is an exploded cross-sectional view of another exemplary foaming nozzle.

FIG. 17 is an exploded cross-sectional view of another exemplary foaming nozzle 1700. Foaming nozzle 1700 is similar to foaming nozzle 350. Foaming nozzle 1700 includes housing 1702. Housing 1702 includes a cylindrical inlet opening 1703. Inside cylindrical inlet opening 1703 is restrictor 1710. Restrictor 1710 is an integral part of housing 1702 and has top plate 1711 with one or more openings 1712 therethrough. The lower portion of restrictor 1710 is cylindrical and fits within rotator 1720. In addition, housing 1702 includes one or more cylindrical projecting members 1706 with one or more spaces 1708 therethrough. The spaces 1708 allow air to be drawn into mixing chamber 1736 during operation.

Rotator 1720 includes one or more extrusion passage(s) 1722 and one or more channels 1724 located in its base. An opening 1726 having tapered walls is located in the center of rotator 1720. In addition, foaming chip 1730 is similar to foaming chip 250. Foaming chip 1730 includes mixing chamber 1736 and a base or screen 1732. Screen 1732 includes a plurality of openings 1734.

During operation, liquid L is forced into inlet opening 1703 and through openings 1704. Openings 1704 restrict the flow of liquid L and accelerate the velocity of the liquid L. The liquid L is further forced through extrusion passage(s) 1722, channel(s) 1724 and out of tapered opening 1726. The rotator 1720 accelerates the liquid L and imparts a rotational motion on the liquid L. As the liquid L passes out of tapered opening 1726, it is atomized into a fine mist or spray of droplets. The velocity of the atomized droplets creates a vacuum that draws air into mixing chamber 1736 where the air mixes with the atomized droplets and turns into foam. The foam is further enhanced as it is forced through screen 1732.

While the present invention has been illustrated by the descriptions of embodiments thereof and while the embodiments have been described in considerable detail, it is not the intention of the applicants to restrict or in any way limit the scope of the appended claims to such detail. Additional advantages and modifications will readily appear to those skilled in the art. For example, certain components may be combined and other components may be eliminated. Moreover, elements described with one embodiment may be readily adapted for use with other embodiments. Therefore, the invention, in its broader aspects, is not limited to the specific details, the representative apparatus and illustrative examples shown and described. Accordingly, departures may be made from such details without departing from the spirit or scope of the applicants' general inventive concept.

We claim:

1. A pump for an inverted foam dispensing system comprising:

a connector for connecting the pump to a liquid container, the connector located at the top of the inverted pump during operation;

a compression chamber having an inlet valve and an outlet valve; the compression chamber in fluid communication with a flow restrictor, an atomizer, a mixing chamber, a foaming chip and an outlet, the outlet located at the bottom of the inverted pump during operation;

wherein the inlet valve, outlet valve, flow restrictor, atomizer, mixing chamber, foaming chip and outlet extend along a common axis that extends vertically, and an air inlet into the mixing chamber, the air inlet opening to atmospheric pressure;

wherein during operation, the liquid pump is located below the liquid container and liquid flowing from the compression chamber is accelerated and atomized and enters the mixing chamber at a velocity sufficient to draw in air from the air inlet to mix with the liquid to form a foam.

2. The pump for dispensing a foam product of claim 1 further comprising a rotator that imparts a rotational motion to a liquid as the liquid passes by the rotator.

3. The pump for dispensing a foam product of claim 2 wherein a flow restrictor increases the velocity of the liquid and the rotator further increases the velocity of the liquid.

4. The pump for dispensing a foam product of claim 3 wherein the outlet of the rotator is an atomizer.

5. The pump for dispensing a foam product of claim 1 wherein the compression chamber is formed at least in part with a piston pump.

6. The pump for dispensing a foam product of claim 1 further comprising a rotator, wherein the flow restrictor is located at least partially within the rotator.

7. The pump for dispensing a foam product of claim 1 further comprising a cap for connecting the pump to a liquid container.

8. The pump for dispensing a foam product of claim 7 further comprising a liquid container filled with a foamable liquid.

9. A refill unit for a foam pump dispenser comprising:

a liquid container;

a foam pump connected to the liquid container, wherein the liquid container is located above the foam pump during operation;

the foam pump having a central vertical axis and including an inlet valve;

a compression chamber;

an outlet valve;

a foaming nozzle having a flow restrictor, a rotator, an atomizer and an air inlet open to atmospheric pressure, and an outlet;

wherein the inlet valve, outlet valve, foaming nozzle and outlet extend along the central vertical axis;

wherein the foaming nozzle accelerates the velocity of the liquid, imparts a rotational motion on the liquid, atomizes the liquid and draws in air to mix with the atomized liquid to form a foam that is dispensed out of the outlet.

10. The refill unit of claim 9 wherein the flow restrictor is a cylindrical element located in the flow path.

11. The refill unit of claim 9 wherein the rotator includes one or more extrusion passages for liquid to flow through.

12. The refill unit of claim 9 wherein the rotator includes one or more channels located in its bottom portion and wherein the channels are at least partially tangential to an opening in the bottom of the rotator.

13. The refill unit of claim 12 wherein the opening in the bottom of the rotator has walls that are at least partially sloped.

14. The refill unit of claim 13 wherein the opening in the bottom of the rotator is sized to cause liquid flowing through it to be atomized.

15. An inverted foam pump comprising:

a cap for securing the inverted foam pump to the bottom of a liquid container;

a compression chamber located within the pump body, the compression chamber compressing vertically;

a pump body having an inlet valve;

a valve body located at least partially within the pump body; the valve body having a seal for engaging an interior wall of the pump body;

a first passage between the inlet valve and an interior of the valve body;

a second passage from the interior of the valve body to the exterior of the valve body;

the valve body further having a surface for engaging a valve seat;

a biasing mechanism for biasing the surface of the valve body against the valve seat;

wherein movement of the valve body in a first direction causes liquid to flow past the inlet valve into the valve body and movement in a second direction causes liquid to flow out of the valve body and causes the surface of the valve body to move away from the valve seat and allow liquid to flow out of the pump body; and wherein a foaming nozzle connected to the pump for converting the liquid to a foam includes an atomizer for atomizing the liquid into a fine mist of droplets.

16. The pump of claim 15 further comprising a second valve body, wherein the second valve body forms at least a portion of the valve seat and the second valve body further comprises a cylindrical restrictor, and wherein the foaming nozzle includes a rotator that at least partially surrounds the cylindrical restrictor and imparts a rotational motion on the liquid.

17. The pump of claim 15 wherein the foaming nozzle further comprises an air inlet that opens to atmospheric pressure and wherein the velocity of fluid flowing past the air inlet causes air to be drawn into the foaming nozzle.

18. The pump of claim 17 further comprising a screen, wherein the fine mist of droplets and air are mixed together and forced through the screen to create a foam.

* * * * *